US011369893B1

(12) United States Patent
Gagliardi

(10) Patent No.: US 11,369,893 B1
(45) Date of Patent: Jun. 28, 2022

(54) MODULAR SHOW STAGE APPARATUS

(71) Applicant: Heidi Gagliardi, Port Orange, FL (US)

(72) Inventor: Heidi Gagliardi, Port Orange, FL (US)

( * ) Notice: Subject to any disclaimer, the term of this patent is extended or adjusted under 35 U.S.C. 154(b) by 0 days.

(21) Appl. No.: 17/224,993

(22) Filed: Apr. 7, 2021

(51) Int. Cl.
*A63J 1/02* (2006.01)
*A45C 9/00* (2006.01)

(52) U.S. Cl.
CPC ..... *A63J 1/02* (2013.01); *A45C 9/00* (2013.01); *A63J 2001/024* (2013.01)

(58) Field of Classification Search
CPC . A63J 1/02; A63H 33/00; A63H 33/38; E04C 2/04; A45C 9/00
USPC ..... 446/478–479; 472/75–77; 52/7
See application file for complete search history.

(56) References Cited

U.S. PATENT DOCUMENTS

| | | | | |
|---|---|---|---|---|
| RE26,642 E * | 8/1969 | Bender | A63H 3/52 446/478 |
| 4,917,217 A * | 4/1990 | Rogers | E04G 1/34 182/152 |
| 8,016,089 B1 | 9/2011 | McNichols | |
| 8,668,543 B2 * | 3/2014 | Manrique | A63J 19/00 446/147 |

FOREIGN PATENT DOCUMENTS

| | | |
|---|---|---|
| JP | 3157853 U | 3/2010 |
| KR | 200443847 Y1 | 3/2009 |

OTHER PUBLICATIONS

Performance Stage, https://beautyharmonylife.com/10-fun-ideas-to-decorate-your-kids-room/.

* cited by examiner

*Primary Examiner* — Kien T Nguyen

(57) ABSTRACT

A modular show stage apparatus includes a foldable base, a front-left pole assembly, a front-right pole assembly, a rear-left pole assembly, a rear-right pole assembly, a plurality of cross poles, and set of curtains. The front-left pole assembly, the front-right pole assembly, the rear-left pole assembly, the rear-right pole assembly are perimetrically mounted to the foldable base. The plurality of cross bars is mounted to the pole assemblies and functions as the roofing structure for the modular show stage apparatus. The set of curtains is attached to the plurality of cross poles so that the rear side, the left side, and the right side of the modular show stage apparatus can be covered. The set of curtains also slidably positioned about the front side of the modular show stage apparatus so that the foldable stage can be open and closed for the audience.

11 Claims, 9 Drawing Sheets

MODULAR SHOW STAGE APPARATUS

FIELD OF THE INVENTION

The present invention generally relates to a portable show stage. More specifically, the present invention is a modular show stage apparatus that can be easily transported and assembled so that an entertainer is able to get a pop up performance stage to conduct their show.

BACKGROUND OF THE INVENTION

In theatre and performing arts, the stage is a designated space for the performance, production, or show. The stage provides a space for entertainers to conduct their performance and also function as a focal point for the audience. Most of the existing stages are stationary structural bodies within a theater or other entertainment related buildings. Stationary stages are generally designed for larger audience and specialty shows, and do not provide flexibility to the entertainers. As a result, entertainers generally prefer portable stages that can be customized according to the audience, terrain, and any other specific requirements of the entertainer. However, these aforementioned portable stages tend to be expensive, cumbersome, and difficult to transport or set up for an individual entertainer.

It is therefore an objective of the present invention to provide a modular show stage apparatus that can be easily transported and assembled by a single individual. The present invention includes a foldable base that can easily fit into an entertainer's vehicle. Other structural components such as poles, brackets, and curtains are designed to fit within the foldable base so that the user can easily transport the present invention. Furthermore, the components and their configuration also allow an easier assembling/disassembling process for the user.

DETAIL DESCRIPTIONS OF THE INVENTION

All illustrations of the drawings are for the purpose of describing selected versions of the present invention and are not intended to limit the scope of the present invention.

Figure 1:
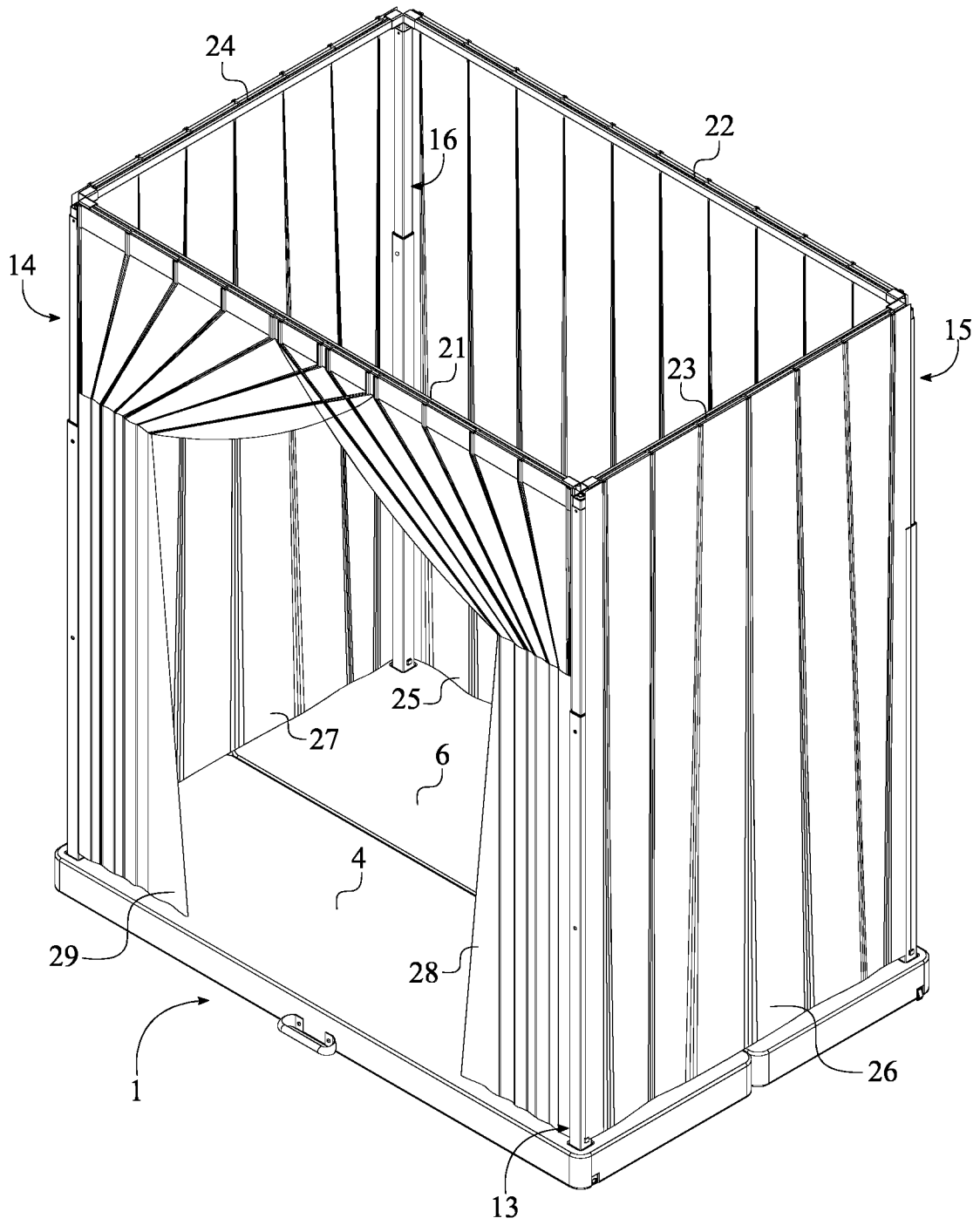
FIG. 1 is a perspective view of the present invention.
Figure 2:
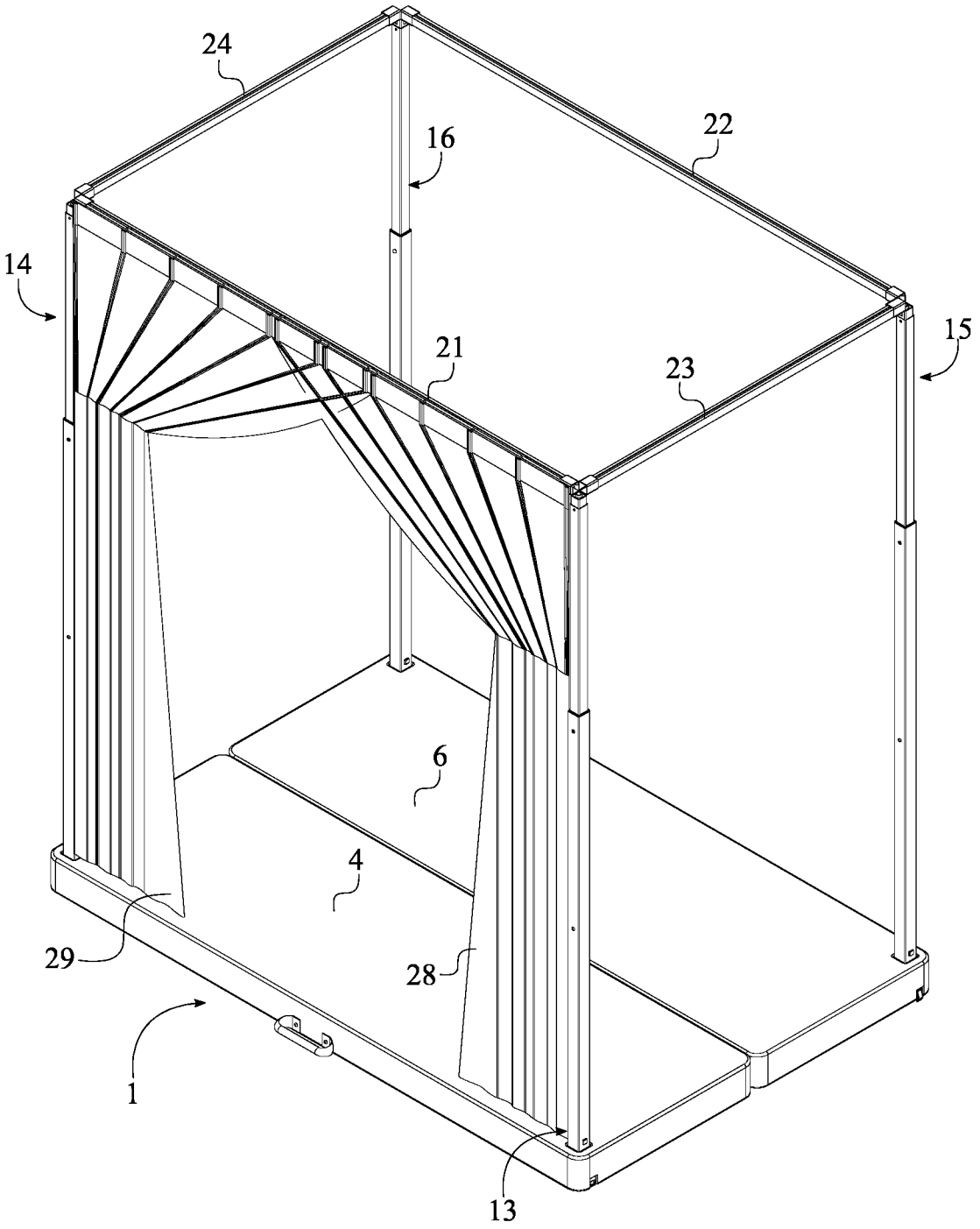
FIG. 2 is a perspective view of the present invention without showing the left curtain, the right curtain, and the rear curtain.
Figure 3:
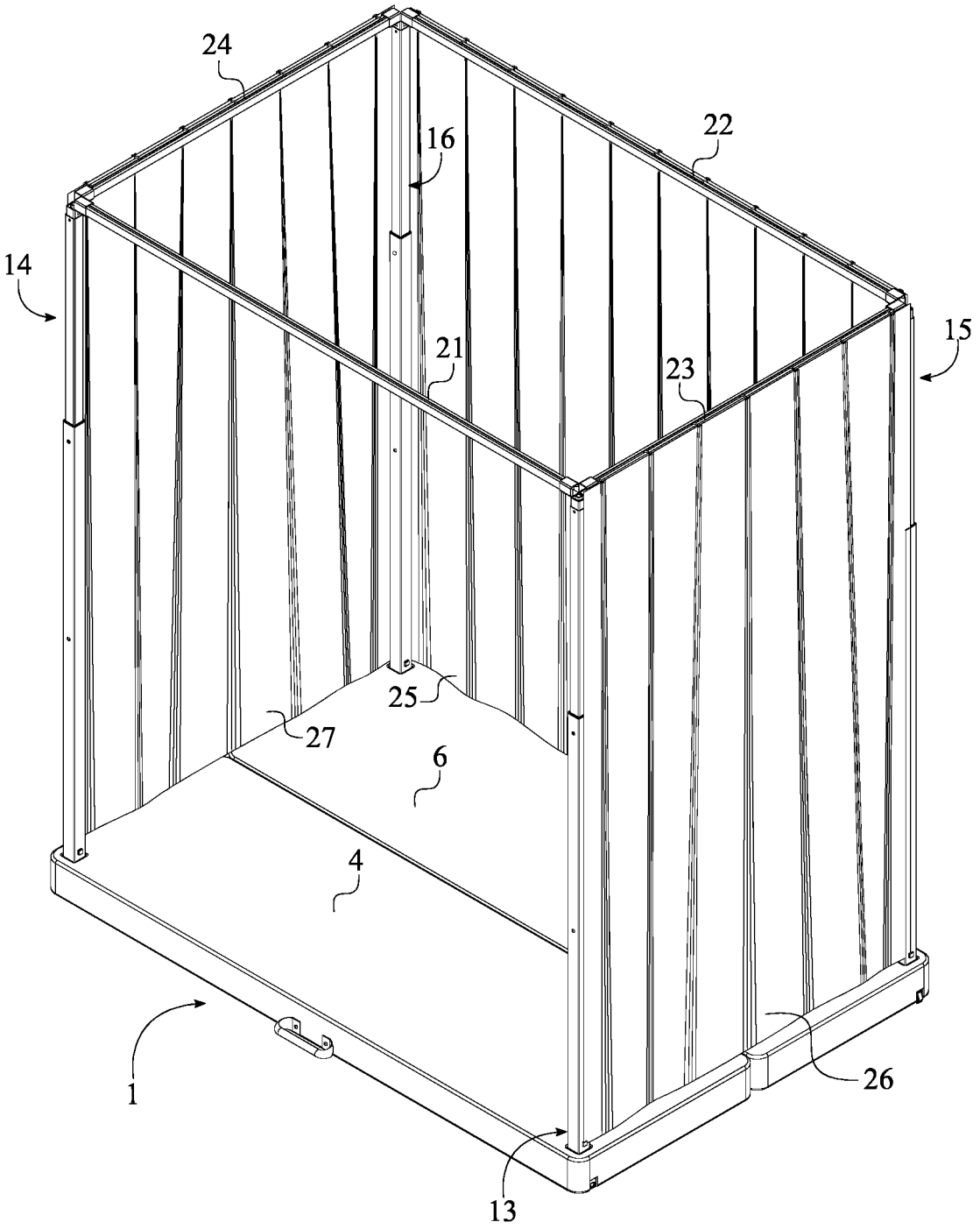
FIG. 3 is a perspective view of the present invention without showing the front-left curtain and the front-right curtain.

The present invention is a modular show stage apparatus that can be easily assembled, disassembled, and transported by a single individual. The present invention easily fits into your daily commuting vehicle and does not requires a trailer or any other similar vehicular attachment to transport. Once assembled, the present invention provides a designated space for the user to conduct their performance and also function as a focal point for the audience. The present invention comprises a foldable base 1, a front-left pole assembly 13, a front-right pole assembly 14, a rear-left pole assembly 15, a rear-right pole assembly 16, a front cross pole 21, a rear cross pole 22, a left cross pole 23, a right cross pole 24, a front-left curtain 28, a front-right curtain 29, a rear curtain 25, a left curtain 26, and a right curtain 27 as shown in FIG. 1-3. The foldable base 1 comprises a front platform 4, a rear platform 6, and at least one hinge 8 as shown in FIG. 6.

In reference to the general configuration of the present invention, as shown in FIG. 1, the front platform 4 and the rear platform 6 are foldably connected to each other by the at least one hinge 8 so that the foldable base 1 can function as the elevated stage. The front-left pole assembly 13 and the front-right pole assembly 14 are oppositely mounted to the front platform 4, wherein the front-left pole assembly 13 and the front-right pole assembly 14 function as the front corner post to support all the cross poles and the curtains. The rear-left pole assembly 15 and the rear-right pole assembly 16 are oppositely mounted to the rear platform 6, wherein the rear-left pole assembly 15 and the rear rear-right pole assembly 16 function as the rear corner post to support all the cross poles and the curtains. More specifically, the front cross pole 21 is perpendicularly mounted to the front-left pole assembly 13 and the front-right pole assembly 14. As a result, the front-left curtain 28 is slidably attached along the front cross pole 21 and positioned adjacent to the front-left pole assembly 13. The front-right curtain 29 is slidably attached along the front cross pole 21 and positioned adjacent to the front-right pole assembly 14. Due to the slidable attachments, the front-left curtain 28 and the front-right curtain 29 can be opened and closed about the foldable base 1. The rear cross pole 22 is perpendicularly mounted to the rear-left pole assembly 15 and the rear-right pole assembly 16 so that the rear curtain 25 can be attached. The left cross pole 23 is perpendicularly mounted to the front-left pole assembly 13 and the rear-left pole assembly 15 so that the left curtain 26 can be attached. The right cross pole 24 is perpendicularly mounted to the front-right pole assembly 14 and the rear-right pole assembly 16 so that the right curtain 27 can be attached.

Figure 6:
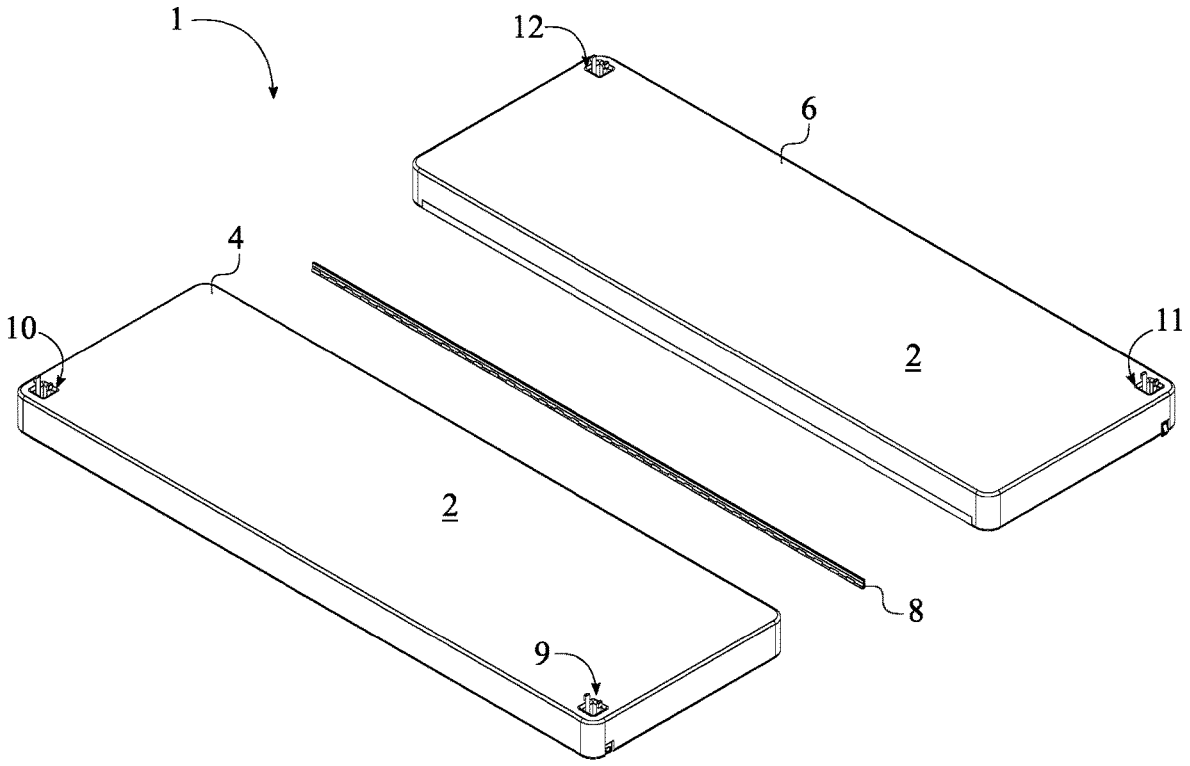
FIG. 6 is an exploded view of the foldable base of the present invention.

In reference to FIG. 6, the front platform 4 and the rear platform 6 are preferably formed into a rectangular shape so that the foldable base 1 can have a front surface, a rear surface, a left surface, and a right surface. When the front platform 4 and the rear platform 6 are configured in the unfolded position, a top surface 2 of the foldable base 1 is positioned coplanar with respect to the front platform 4 and the rear platform 6. In other words, the front platform 4 and the rear platform 6 are unfolded into a flat surface area to eliminate any trip hazards about the at least one hinge 8. In reference to FIG. 7, an underside of the front platform 4 and the rear platform 6 delineate an empty space that functions as a storage compartment so that the front-left pole assembly 13, the front-right pole assembly 14, the rear-left pole assembly 15, the rear-right pole assembly 16, the front cross pole 21, the rear cross pole 22, the left cross pole 23, the right cross pole 24, the front-left curtain 28, the front-right curtain 29, the rear curtain 25, the left curtain 26, and the right curtain 27 can be stored. Furthermore, the present invention further comprises a plurality of structural supports to evenly distribute the user's weight. More specifically, the plurality of structural supports is interspaced within the underside of the front platform 4 and the rear platform 6 thus allowing the plurality of structural supports to adjacently connect to a bottom surface 3 of the foldable base 1.

In reference to FIG. 6, the at least one hinge 8 is preferably extended cross the front platform 4 and the rear platform 6 from the left surface to the right surface. As a result, the at least one hinge 8 is able to provide sufficient structural assistance to the rotation of the front platform 4 and the rear platform 6 when the foldable base 1 is configured from the unfolded position to folded position and vice versa.

Figure 4:
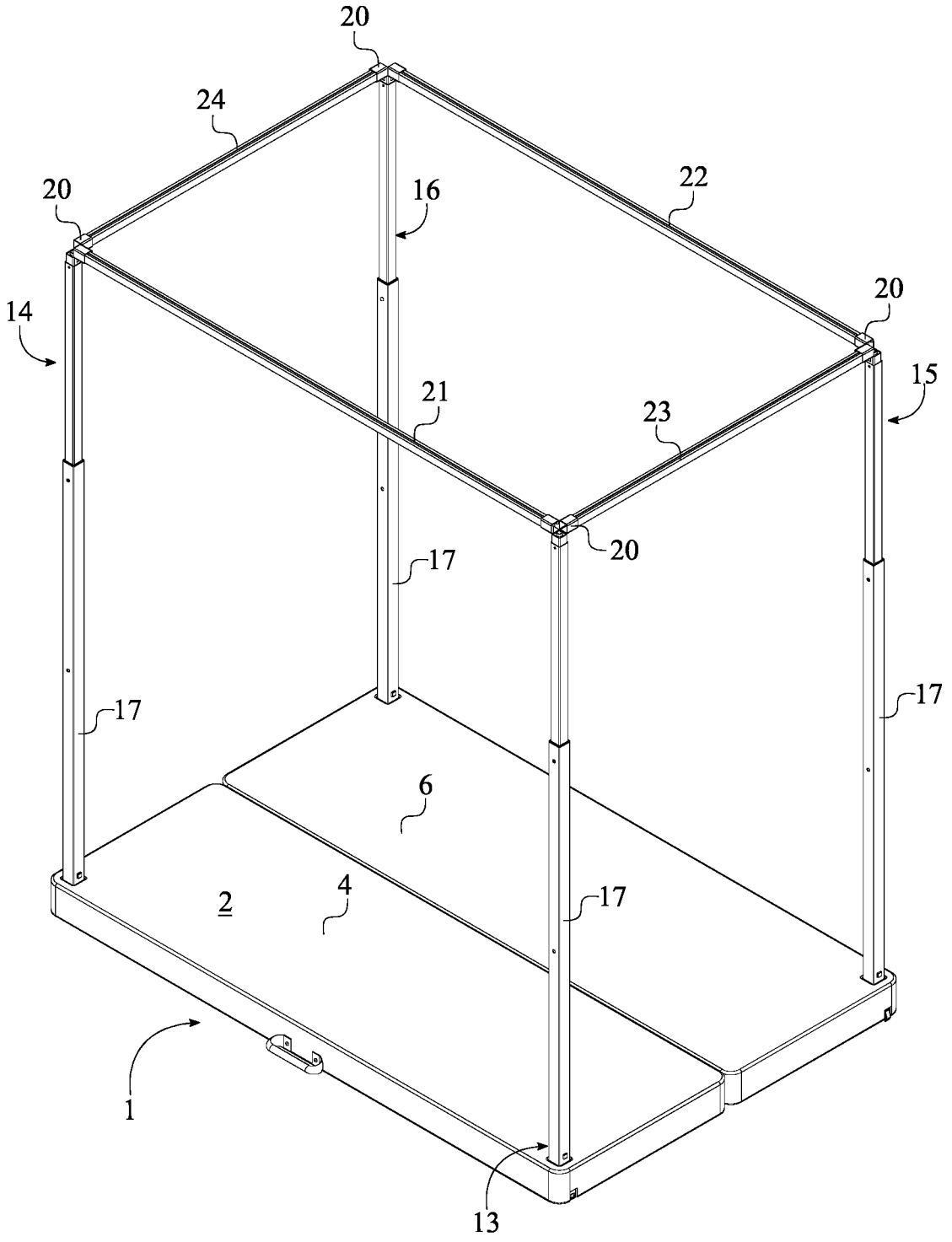
FIG. 4 is a perspective view of the present invention without showing the left curtain, the right curtain, the rear curtain the front-left curtain, and the front-right curtain.
Figure 5:
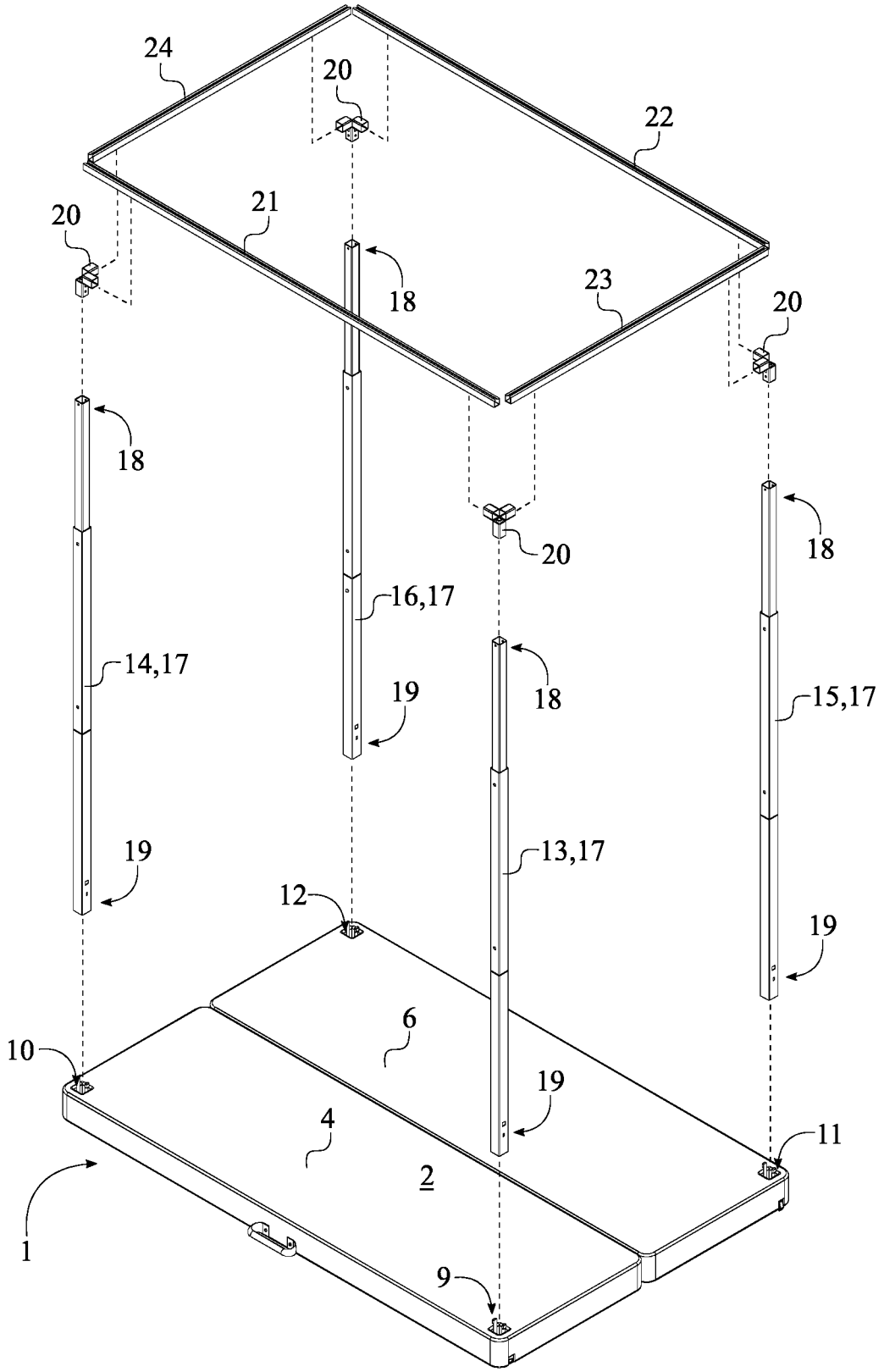
FIG. 5 is an exploded view of the present invention without showing the left curtain, the right curtain, the rear curtain the front-left curtain, and the front-right curtain.

In reference to FIG. 4-5, the front-left pole assembly 13, the front-right pole assembly 14, the rear-left pole assembly 15, and the rear-right pole assembly 16 each comprises a telescopic pole 17 and a mounting bracket 20. More specifically, the telescopic pole 17 determines the height of the present invention as the mounting bracket 20 is terminally connected to a top end 18 of the telescopic pole 17. The telescopic pole 17 also allows the user to adjust the total height of the present invention according to the user's preference. In order to perimetrically position each of the pole assembly, the foldable base 1 further comprises a front-left opening 9, a front-right opening 10, a rear-left opening 11, and a rear-right opening 12. As shown in FIG. 5, the front-left opening 9 traverses into the front platform 4 through the top surface 2 and positioned adjacent to the corner connection of the front surface and the left surface. A bottom end 19 of the telescopic pole 17 for the front-left pole assembly 13 is terminally mounted to the front platform 4 through the front-left opening 9. The front-right opening 10 traverses into the front platform 4 through the top surface 2 and positioned adjacent to the corner connection of the front surface and the right surface. A bottom end 19 of the telescopic pole 17 for the front-right pole assembly 14 is terminally mounted to the front platform 4 through the front-right opening 10. The rear-left opening 11 traverses into the rear platform 6 through the top surface 2 and positioned adjacent to the corner connection of the rear surface and the left surface. A bottom end 19 of the telescopic pole 17 for the rear-left pole assembly 15 is terminally mounted to the rear platform 6 through the rear-left opening 11. The rear-right opening 12 traverses into the rear platform 6 through the top surface 2 and positioned adjacent to the corner connection of the rear surface and the right surface. A bottom end 19 of the telescopic pole 17 for the rear-right pole assembly 16 is terminally mounted to the front platform 4 through the rear-right opening 12. As a result, the front-left pole assembly 13, the front-right pole assembly 14, the rear-left pole assembly 15, and the rear-right pole assembly 16 are able to function as the four vertical structural poles of the present invention so that the cross poles and the curtains can be attached.

Furthermore, the front-left opening 9 and the front-right opening 10 are positioned parallel to the rear-left opening 11 and the rear-right opening 12 so that a left distance between the front-left opening 9 and the rear-left opening 11 is equal to a right distance between the front-right opening 10 and the rear-right opening 12. Similarly, the front-left opening 9 and the rear-left opening 11 are positioned parallel to the front-right opening 10 and the rear-right opening 12 so that a front distance between the front-left opening 9 and the front-right opening 10 is equal to a rear distance between the rear-left opening 11 and the rear-right opening 12.

In reference to FIG. 2 and FIG. 4, the front cross pole 21 is perpendicularly mounted to the mounting bracket 20 of the front-left pole assembly 13 and the front-right pole assembly 14 thus extending along the front distance. As a result, the front-left curtain 28 is slidably attached to the front cross pole 21 thus allowing the front-left curtain 28 to slide toward or away from the front-left pole assembly 13. Similarly, the front-right curtain 29 is slidably attached to the front cross pole 21 thus allowing the front-right curtain 29 to slide toward or away from the front-right pole assembly 14. Due to the slidable attachment of the front-left curtain 28 and the front-right curtain 29, the foldable base 1 can be opened and closed to the audience.

In reference to FIG. 3-4, the rear cross pole 22 is perpendicularly mounted to the mounting bracket 20 of the rear-left pole assembly 15 and the rear-right pole assembly 16 thus extending along the rear distance. As a result, the rear curtain 25 can be attached along the rear cross pole 22 and extended in between the rear-left pole assembly 15 and the rear-right pole assembly 16. The rear curtain 25 functions as the backdrop of the present invention and blocks away the surrounding area behind the present invention from the audience.

In reference to FIG. 3-4, the left cross pole 23 is perpendicularly mounted to the mounting bracket 20 of front-left pole assembly 13 and the rear-left pole assembly 15 thus extending along the left distance. As a result, the left curtain 26 can be attached along the left cross pole 23 and extended in between the front-left pole assembly 13 and the rear-left pole assembly 15. The left curtain 26 functions as a side cover to the present invention so that the user can blocks away the left surrounding area of the present invention if necessary.

In reference to FIG. 3-4, the right cross pole 24 is perpendicularly mounted to the mounting bracket 20 of front-right pole assembly 14 and the rear-right pole assembly 16 thus extending along the right distance. As a result, the right curtain 27 can be attached along the right cross pole 24 and extended in between the front-right pole assembly 14 and the rear-right pole assembly 16. The right curtain 27 also functions as a side cover to the present invention so that the user can blocks away the right surrounding area of the present invention if necessary.

If necessary, the rear curtain 25, the left curtain 26, and the right curtain 27 can also utilize a slidable attachment to their corresponding cross pole thus allowing the user to selectively open and close all four sides of the foldable base 1 based upon the performance and/or the placement of the audience.

Figure 7:
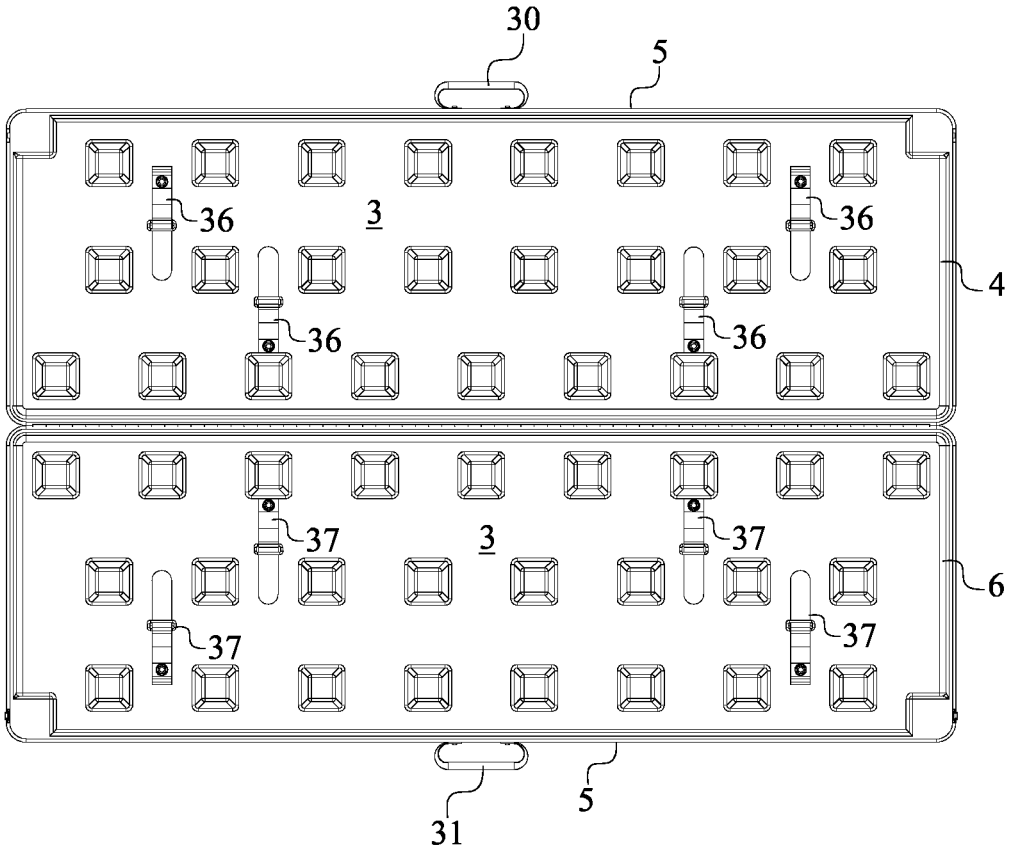
FIG. 7 is a bottom view of the present invention.

In reference to FIG. 7, the present invention further comprises at least one front handle 30 and at least one rear handle 31. More specifically, the at least one front handle 30 is connected to an outside surface 5 of the front platform 4 that is also identified as the front surface of the foldable base 1. The at least one rear handle 31 is connected to an outside surface 5 of the rear platform 6 that is also identified as the rear surface of the foldable base 1. The front handle 30 and the rear handle 31 function as gripping bodies within the present invention so that the user move the foldable base 1 from one place to another. For example, when the present invention is in the folded position, the user can use both the front handle 30 and the rear handle 31 to move the present invention. When the present invention is in the folded position, the user can use the front handle 30 to move the foldable base 1 with respect to the front platform 4 or the rear handle 31 to move the foldable base 1 with respect to the rear platform 6.

Figure 8:
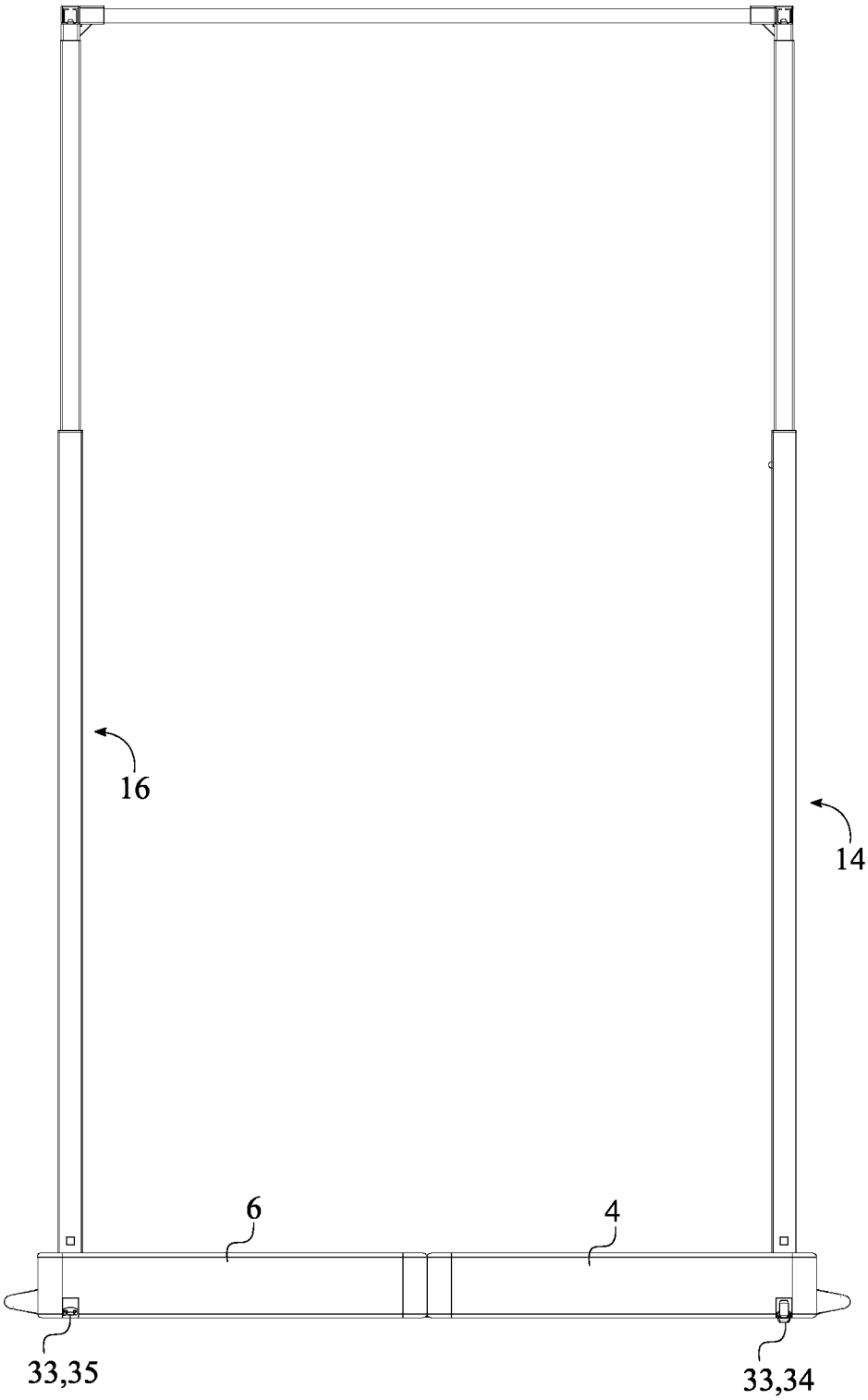
FIG. 8 is a right side view of the present invention without showing the curtains.
Figure 9:
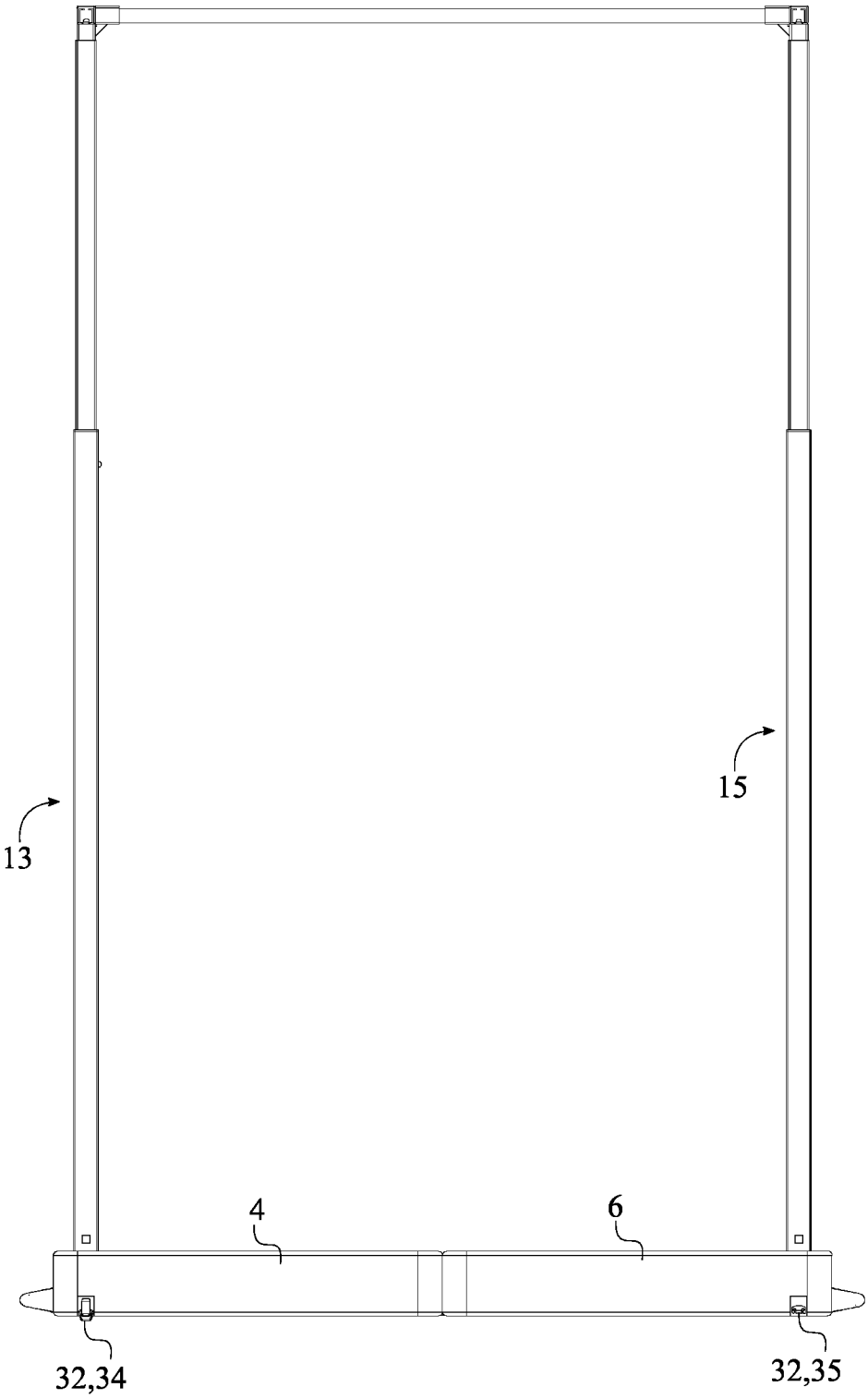
FIG. 9 is a left side view of the present invention without showing the curtains.

In reference to FIG. 8-9, the present invention further comprises a left latching mechanism 32 and a right latching mechanism 33. Furthermore, the left latching mechanism 32 and the right latching mechanism 33 each comprises a first engaging body 34 and a second engaging body 35 so that the front platform 4 and the rear platform 6 can be attached to each other within the folded position. As a result, the left latching mechanism 32 and the right latching mechanism 33 are able to eliminate any accidental unfolding of the foldable base 1. More specifically, the first engaging body 34 of the left latching mechanism 32 is laterally connected onto the front platform 4 and positioned adjacent to the front-left pole assembly 13. The second engaging body 35 of the left latching mechanism 32 is laterally connected onto the rear platform 6 and positioned adjacent to the rear-left pole assembly 15. The first engaging body 34 of the right latching mechanism 33 is laterally connected onto the front platform 4 and positioned adjacent to the front-right pole assembly 14. The second engaging body 35 of the right latching mechanism 33 is laterally connected onto the rear platform 6 and positioned adjacent to the rear-right pole assembly 16. When the foldable base 1 is in the folded position, the first engaging body 34 and the second engaging body 35 for the left latching mechanism 32 are adjacently aligned with each other. As a result, the user can engage the first engaging body 34 of the left latching mechanism 32 with the second engagement body of the left latching mechanism 32 thus securing the folded position with respect to the left surface of the foldable base 1. Similarly, the first engaging body 34 and the second engaging body 35 for the right latching mechanism 33 are adjacently aligned with each other when the foldable base 1 is in the folded position. As a result, the user can engage the first engaging body 34 of the right latching mechanism 33 with the second engaging body 35 of the right latching mechanism 33 thus securing the folded position with respect to the right surface of the foldable base 1.

In reference to FIG. 7, the present invention further comprises at least one front pair of pole straps 36 and at least one rear pair of pole straps 37. More specifically, the front pair of pole straps 36 is connected along the bottom surface 3 of the front platform 4. The rear pair of pole straps 37 is connected along the bottom surface 3 of the rear platform 6. The front pair of pole straps 36 and the rear pair of pole straps 37 function as securing straps within the present invention to tie-down and secure the front-left pole assembly 13, the front-right pole assembly 14, the rear-left pole assembly 15, the rear-right pole assembly 16, the front cross pole 21, the rear cross pole 22, the left cross pole 23, and the right cross pole 24.

Although the invention has been explained in relation to its preferred embodiment, it is to be understood that many other possible modifications and variations can be made without departing from the spirit and scope of the invention as hereinafter claimed.

What is claimed is:

1. A modular show stage apparatus comprising:
a foldable base;
a front-left pole assembly;
a front-right pole assembly;
a rear-left pole assembly;
a rear-right pole assembly;
a front cross pole
a rear cross pole;
a left cross pole;
a right cross pole;
a front-left curtain;
a front-right curtain;
the foldable base comprising a front platform, a rear platform, and at least one hinge;
the front platform and the rear platform being foldably connected to each other by the at least one hinge;
the front-left pole assembly and the front-right pole assembly being oppositely mounted to the front platform;
the rear-left pole assembly and the rear-right pole assembly being oppositely mounted to the rear platform;
the front cross pole being perpendicularly mounted to the front-left pole assembly and the front-right pole assembly;
the rear cross pole being perpendicularly mounted to the rear-left pole assembly and the rear-right pole assembly;
the left cross pole being perpendicularly mounted to the front-left pole assembly and the rear-left pole assembly;
the right cross pole being perpendicularly mounted to the front-right pole assembly and the rear-right pole assembly;
the front-left curtain being slidably attached along the front cross pole;
the front-right curtain being slidably attached along the front cross pole;
the front-left curtain being positioned adjacent to the front-left pole assembly;
the front-right curtain being positioned adjacent to the front-right pole assembly;
at least one front pair of pole straps; and
the front pair of pole straps being connected along a bottom surface of the front platform.

2. The modular show stage apparatus as claimed in claim 1 comprising:
at least one front handle; and
the at least one front handle being connected to an outside surface of the front platform.

3. The modular show stage apparatus as claimed in claim 2 comprising:
at least one rear pair of pole straps; and
the rear pair of pole straps being connected along a bottom surface of the rear platform.

4. The modular show stage apparatus as claimed in claim 1 comprising:
at least one rear handle; and
the at least one rear handle being connected to an outside surface of the rear platform.

5. The modular show stage apparatus as claimed in claim 1 comprising:
a left latching mechanism;
a right latching mechanism;
the left latching mechanism and the right latching mechanism each comprising a first engaging body and a second engaging body;
the first engaging body of the left latching mechanism being laterally connected onto the front platform;
the first engaging body of the left latching mechanism being positioned adjacent to the front-left pole assembly;
the second engaging body of the left latching mechanism being laterally connected onto the rear platform;
the second engaging body of the left latching mechanism being positioned adjacent to the rear-left pole assembly;
the first engaging body of the right latching mechanism being laterally connected onto the front platform;

the first engaging body of the right latching mechanism being positioned adjacent to the front-right pole assembly;

the second engaging body of the right latching mechanism being laterally connected onto the rear platform; and the second engaging body of the right latching mechanism being positioned adjacent to the rear-right pole assembly.

6. The modular show stage apparatus as claimed in claim 1 comprising:

a rear curtain;

the rear curtain being attached along the rear cross pole; and the rear curtain being positioned in between the rear-left pole assembly and the rear-right pole assembly.

7. The modular show stage apparatus as claimed in claim 1 comprising:

a left curtain;

the left curtain being attached along the left cross pole; and the left curtain being positioned in between the front-left pole assembly and the rear-left pole assembly.

8. The modular show stage apparatus as claimed in claim 1 comprising:

a right curtain;

the right curtain being attached along the right cross pole; and the right curtain being positioned in between the front-right pole assembly and the rear-right pole assembly.

9. The modular show stage apparatus as claimed in claim 1 comprising:

the front-left pole assembly, the front-right pole assembly, the rear-left pole assembly, and the rear-right pole assembly each comprising a telescopic pole and a mounting bracket;

the foldable base further comprising a top surface, a front-left opening, a front-right opening, a rear-left opening, and a rear-right opening;

a top end of the telescopic pole being terminally connected to the mounting bracket;

the front-left opening traversing into the front platform through the top surface;

the front-right opening traversing into the front platform through the top surface;

the rear-left opening traversing into the rear platform through the top surface;

the rear-right opening traversing into the rear platform through the top surface;

a bottom end of the telescopic pole for the front-left pole assembly being terminally mounted to the front platform through the front-left opening;

a bottom end of the telescopic pole for the front-right pole assembly being terminally mounted to the front platform through the front-right opening;

a bottom end of the telescopic pole for the rear-left pole assembly being terminally mounted to the rear platform through the rear-left opening; and a bottom end of the telescopic pole for the rear-right pole assembly being terminally mounted to the front platform through the rear-right opening.

10. The modular show stage apparatus as claimed in claim 9 comprising:

the front cross pole being perpendicularly mounted to the mounting bracket of the front-left pole assembly and the front-right pole assembly;

the rear cross pole being perpendicularly mounted to the mounting bracket of the rear-left pole assembly and the rear-right pole assembly;

the left cross pole being perpendicularly mounted to the mounting bracket of the front-left pole assembly and the rear-left pole assembly; and the right cross pole being perpendicularly mounted to the mounting bracket of the front-right pole assembly and the rear-right pole assembly.

11. The modular show stage apparatus as claimed in claim 9 comprising:

the front-left opening and the front-right opening being positioned parallel to the rear-left opening and the rear-right opening; and the front-left opening and the rear-left opening being positioned parallel to the front-right opening and the rear-right opening.

* * * * *